United States Patent [19]

Breeding

[11] 4,111,320

[45] Sep. 5, 1978

[54] MATERIAL HANDLING APPARATUS HAVING MEANS FOR CONNECTING MATERIAL HANDLING TOOL WITH A BOOM

[75] Inventor: Robert D. Breeding, New Philadelphia, Ohio

[73] Assignee: The Warner & Swasey Company, Cleveland, Ohio

[21] Appl. No.: 780,316

[22] Filed: Mar. 23, 1977

[51] Int. Cl.[2] ..... E02F 3/96

[52] U.S. Cl. ..... 214/145 A; 172/272; 403/374

[58] Field of Search ..... 214/138 R, 131 A, 145 R, 214/145 A; 37/118 R, 118 A; 403/37.4; 172/272, 273

[56] References Cited

U.S. PATENT DOCUMENTS

| | | | |
|---|---|---|---|
| 2,963,183 | 12/1960 | Przybylski | 214/138 R X |
| 3,556,323 | 1/1971 | Heimmermann | 214/145 A |
| 3,874,533 | 4/1975 | Montgomery et al. | 214/145 A |
| 3,934,738 | 1/1976 | Arnold | 214/145 A |

FOREIGN PATENT DOCUMENTS

| | | | |
|---|---|---|---|
| 2,460,589 | 6/1976 | Fed. Rep. of Germany | 403/374 |

*Primary Examiner*—L. J. Paperner

[57] ABSTRACT

An improved material handling apparatus includes an adapter assembly which is disposed on the outer end portion of a boom. The adapter assembly is connected with a material handling tool by an improved connector assembly. The connector assembly includes a wedge member having a pair of sloping side surfaces which cooperate with a wedge surface on the material handling tool and a wedge surface on the adapter assembly to interconnect the adapter assembly and the material handling tool. The wedge member cooperates with the wedge surfaces on the material handling tool and the adapter assembly in such a manner as to positively seat a support bar on the material handling tool in a recess on the adapter assembly. In addition, the interaction between the wedge member and the two wedge surfaces is such as to compensate for wear between the wedge member and the wedge surfaces and to compensate for slight misalignments between the adapter assembly and the material handling tool.

9 Claims, 5 Drawing Figures

FIG. 1
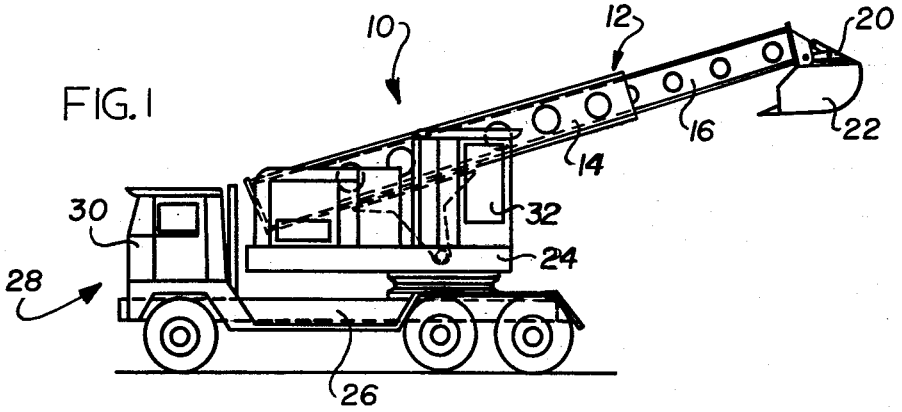
FIG. 5
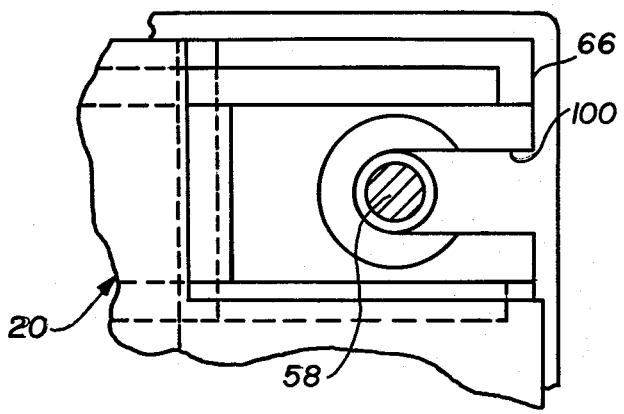
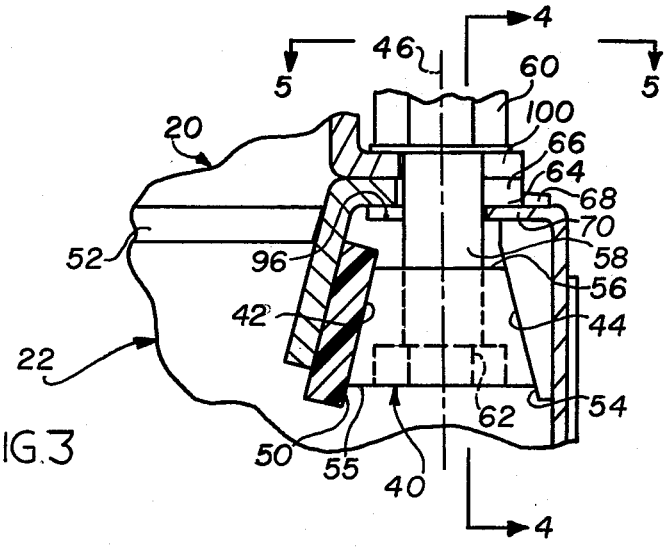
FIG. 3

MATERIAL HANDLING APPARATUS HAVING MEANS FOR CONNECTING MATERIAL HANDLING TOOL WITH A BOOM

BACKGROUND OF THE INVENTION

This invention relates to a material handling apparatus and more specifically to an improved connector assembly for releasably connecting a material handling tool with the outer end of a boom.

Many different types of material handling tools are frequently utilized in association with booms to perform different types of jobs. For example, excavating buckets are frequently utilized for general excavating and trenching. When a relatively long roadside ditch is to be cleaned and graded, a ditching bucket having a substantially longer ground engaging lip is advantageously utilized in place of the relatively narrow excavating bucket. When concrete or asphalt pavement is to be broken up, it is desirable to utilize a relatively strong pavement removal bucket having heavy duty teeth.

In order to connect these various material handling tools with the end of a boom, an adapter assembly which is engageable with each of the material handling tools has previously been utilized. This adapter assembly includes a movable base having a recess which engages a support bar on the selected material handling tool. Bolts have been utilized to connect the end portion of the adapter base opposite from the recess to a material handling tool. If an operator is careless in connecting the adapter with the material handling tool, the connection between the tool and the adapter could be such as to subject the connector bolts to excessive shear forces which could cause a breaking of the bolts during operation of the material handling apparatus. In addition, after the material handling apparatus has been utilized for relatively long periods of time, extensive wear of the adapter assembly could result in a loose fit between the adapter assembly and the material handling tool in such a manner as to cause the application of excessive shear forces to connector bolts.

SUMMARY OF THE PRESENT INVENTION

The present invention provides a material handling apparatus in which an adapter assembly on the outer end of a boom is connected with a selected material handling tool by an improved connector assembly. The connector assembly includes a wedge member which cooperates with surfaces on the adapter assembly and the material handling tool to securely interconnect the material handling tool and the adapter assembly. The wedging action between the surfaces is such as to compensate for wear between the various parts of the material handling apparatus and to press a recess in the adapter assembly into secure engagement with a support member on the material handling tool. In addition, the wedging action between the wedge member and the wedge surfaces is such as to compensate for a slight misalignment between the adapter assembly and the material handling tool during connection.

Accordingly, it is an object of this invention to provide a material handling apparatus having a new and improved connector assembly to connect a material handling tool with an adapter assembly on a boom and wherein the connector assembly includes a wedge member having a pair of sloping side surfaces whcih cooperate with a wedge surface on the material handling tool and a wedge surface on the adapter assembly to securely interconnect the material handling tool and the adapter assembly.

Another object of this invention is to provide a new and improved material handling apparatus as set forth in the next preceding object and wherein the interaction between the wedge member and the wedge surfaces on the material handling tool and adapter assembly is such as to promote tight engagement of a support bar on the material handling tool with a recess in the adapter assembly.

BRIEF DESCRIPTION OF THE DRAWINGS

The foregoing and other objects and features of the present invention will become more apparent upon a consideration of the following description taken in connection with the accompanying drawings wherein:

FIG. 1 is an illustration of a material handling apparatus having a boom which is connected with a material handling tool by a connector assembly constructed in accordance with the present invention;

FIG. 3 (on the first sheet of drawings) is an enlarged fragmentary sectional view further illustrating the manner in which the connector assembly interconnects the mateial handling tool and the adapter assembly;

FIG. 5 (on the first sheet of drawings) is a fragmentary view, taken generally along the line 5—5 of FIG. 3, further illustrating the manner in which the material handling tool and adapter assembly are interconnected.

DESCRIPTION OF ONE SPECIFIC PREFERRED EMBODIMENT OF THE INVENTION

Figures 2, 4:
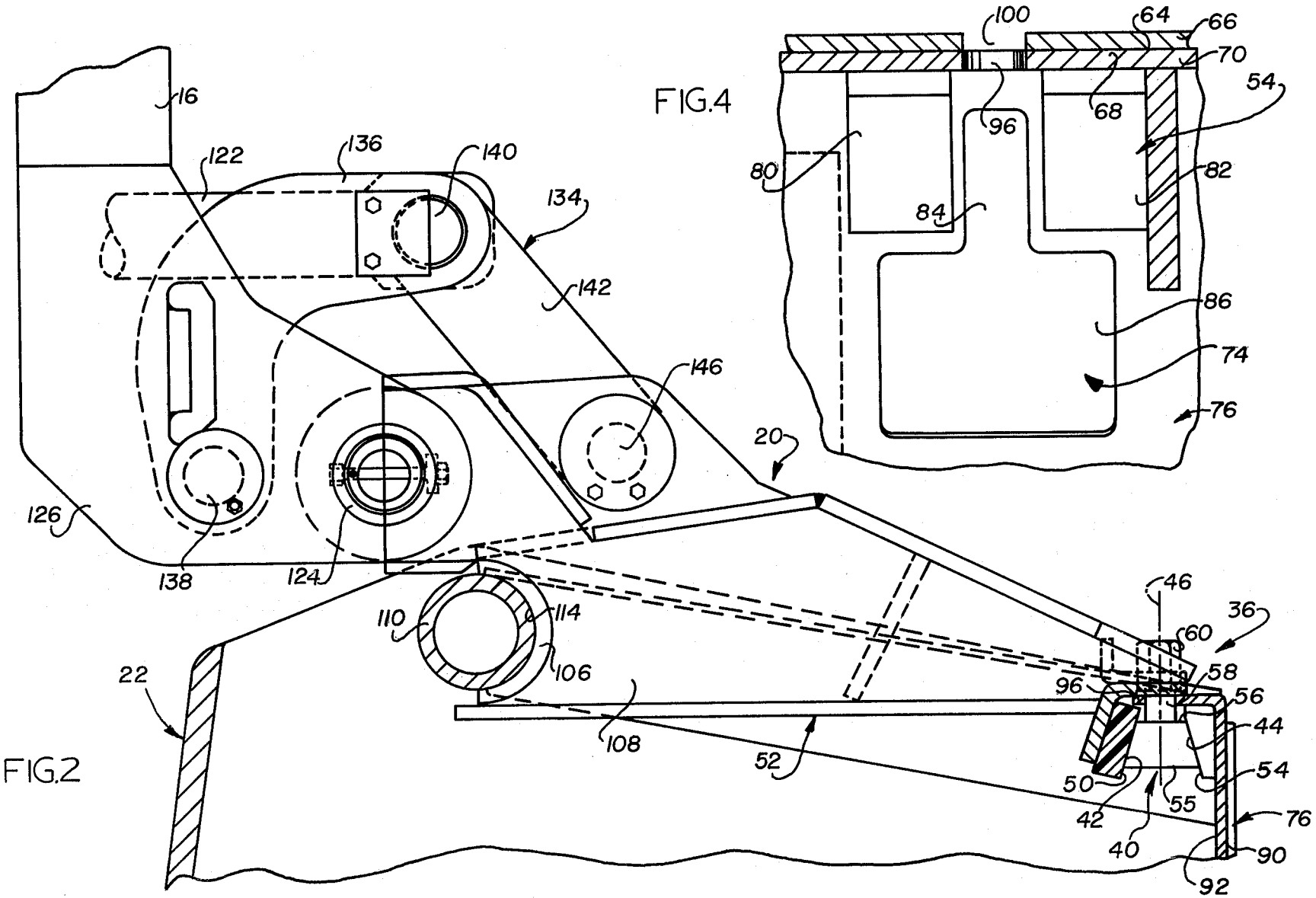
FIG. 2 is an enlarged fragmentary sectional view illustrating the manner in which an adapter assembly on the outer end of the boom of the apparatus of FIG. 1 is connected with a material handling tool by the improved connector assembly.
FIG. 4 (on the second sheet of drawings) is an enlarged fragmentary sectional view, taken generally along the line 4—4 of FIG. 3, illustrating the relationship between an access opening formed in the material handling tool and a pair of wedging surfaces disposed on the material handling tool.

A material handling apparatus 10 includes a boom 12 having a pair of telescoping sections 14 and 16. An adapter assembly 20 is mounted on the outer end of the boom section 16 and is utilized in connecting a material handling tool 22 with the boom 12. The boom 12 is pivotally mounted on a platform 24 which is rotatably mounted on the bed 26 of a vehicle 28. The vehicle 28 is provided with two operator cabs, that is forward cab 30 which is occupied by the operator during over-the-road movement of the vehicle and a rearward cab 32 which is occupied by the operator during operation of the boom 12. The general construction of the material handling apparatus 10 is similar to that disclosed in U.S. Pat. Nos. 2,940,623; 2,984,373; 3,587,886; 3,599,814 and 3,666,125. Therefore, the general construction of the material handling apparatus 10 will not be further described herein to avoid prolixity of description.

The adapter assembly 20 is connected with the material handling tool 22 by an improved connector assembly 36 (FIG. 2). The connector assembly 36 includes a wedge member 40 having opposite side surfaces 42 and 44 (FIGS. 2 and 3) which extend at an acute angle relative to each other and to a central axis 46 of the connector assembly 36. The two side surfaces 42 and 44 are disposed in flat planes which extend at an acute angle to each other and intersect at the central axis 46 of the connector assembly 36.

The sloping side surface 42 of the wedge member 40 is disposed in abutting pressure engagement with a similarly sloping wedge surface 50 which is fixedly connected to a base 52 of the adapter assembly 20. The sloping side surface 44 of the wedge member 40 is disposed in abutting pressure engagement with a similarly sloping wedge surface 54 which is fixedly connected with the material handling tool 22. The wedge surfaces 50 and 54 slope at the same angle relative to each other and to the central axis 46 of the connector assembly 36 as do the side surfaces 42 and 44 of the wedge member 40. The lower portions (as viewed in FIGS. 2 and 3) of the wedge surfaces 50 and 54 are spaced further apart than the extent of a base or major end 55 of the wedge member 40 to facilitate positioning of the wedge member between the wedge surfaces. Similarly, the upper portions of the wedge surfaces 50 and 54 are spaced closer together than the extent of a top or minor end 56 of the wedge member 40 to accommodate wear between the wedge member and wedge surfaces.

Although it is contemplated that the wedge surfaces 50 and 54 could slope at many different angles relative to each other and to the central axis 46 of the connector assembly, in one specific preferred embodiment of the invention the wedge surfaces 50 and 54 both extended at an acute angle of 15° to the central axis 46 and were disposed in flat planes which intersect along the central axis 46 and extended at an acute angle of 30° relative to each other. Of course, different angular relationships could be provided between the wedge surfaces 50 and 54 if desired.

The wedge member 40 is pulled into tight abutting engagement with the wedge surfaces 50 and 54 by tightening a nut 60 on a bolt 58. The bolt 58 has a head end portion 62 (see FIG. 3) which is disposed within a recess in the wedge member 40. When the nut 60 is tightened on a threaded end portion of the bolt 58, a lower surface 64 of a flange 66 on the adapter assembly 20 is pulled into tight abutting engagement with an upper surface 68 of an inturned lip 70 on the material handling tool 22. As the nut 60 is tightened, the wedge member 40 is pulled upwardly (as viewed in FIG. 3) and the surface 64 on the adapter assembly 20 is pressed firmly against the surface 68 on the material handling tool 22 to fixedly interconnect the material handling tool and the adapter assembly.

When the adapter assembly 20 is overlying the material handling tool 22 in the manner shown in FIG. 2, access to the interior of the material handling tool 22 is at least partially blocked by the adapter assembly. Since the wedge surfaces 50 and 54 are disposed within the material handling tool 22, it is necessary to provide access to the interior of the material handling tool 22 in order to position the wedge member 40 relative to the wedge surfaces. To provide for this access to the interior of the material handling tool, an opening 74 (FIG. 4) is formed in a side wall 76 of the material handling tool 22.

The wedge surface 54 includes a pair of identical sections 80 and 82 (FIG. 4) which are disposed on opposite sides of a relatively narrow section 84 of the opening 74. This enables the bolt 58 to be moved through the narrow portion 84 of the opening 74 while the wedge member 40 moves through a relatively large main portion 86 of the opening 74. The wedge member and bolt are then moved upwardly to position the side surface 44 on the wedge member 40 in abutting engagement with the two sections 80 and 82 of the wedging surface 54.

After the wedge member 40 has been moved from a location adjacent to an outer side surface 90 of the implement wall 76 to a location adjacent to an inner side surface 92 of the wall 76 by moving the wedge member through the opening 74, the upstanding bolt 58 is moved upwardly through a generally U-shaped slot 96 formed in the inturned flange 70 of the material handling tool 22. The bolt also extends through similar U-shaped slot 100 formed in the edge portion 66 of the adapter assembly 20 (see FIG. 5). It should be noted that the U-shaped slot 100 faces toward the right (as viewed in FIGS. 3 and 5) while the U-shaped slot 96 faces toward the left.

The end portion of the adapter 20 opposite from the connector assembly 36 is connected with the material handling tool 22 by engagement of a semi-circular recess 106 (FIG. 2) formed in a side wall 108 of the adapter assembly with a cylindrical support bar 110 which is fixedly connected with the material handling tool 22. The interaction between the wedge member 40 and the wedge surfaces 50 and 54 causes the arcuate bottom surface 114 of the recess 106 to be pressed firmly against the cylindrical outer side surface of the support bar 110 to hold the support bar and recess in tight abutting pressure engagement. Thus as the nut 60 is tightened on the bolt 58, the wedge member 40 is pulled upwardly (as viewed in FIG. 2). As the wedge member 40 moves upwardly, the wedge surface 54 presses the wedge member toward the left (as viewed in FIG. 2). This forces the wedge surface 50 toward the support bar 110 to firmly seat the support bar in the recess 106.

Therefore, the connector assembly 36 functions to ensure that a tight connection is provided between the adapter assembly 20 and material handling tool 22 at two separate locations. Thus, a portion of the adapter assembly toward the boom section 16 is connected with the material handling tool 22 by the interaction between the recess 106 and the support bar 110. Another portion of the adapter assembly 20 is connected with the opposite side of the material handling tool 22 by the connector assembly 36 to thereby securely interconnect the material handling tool 22 and the adapter assembly 20. It should be understood that although only a single connector assembly 36 has been illustrated in the drawings, a plurality of identical connector assemblies 36 are provided along the lip or outer end portion of the adapter assembly 20 to securely connect it with the material handling tool 22.

If wear should occur at either the wedge surfaces 50 and 54 or the recess 106, the interaction between the wedge member 40 and the wedge surfaces 50 and 54 will be such as to compensate for this wear. As wear occurs, the wedge member 40 is pulled further upwardly (as viewed in FIGS. 2 and 3) as the nut 60 is tightened on the bolt 58. Until excessive wear has occurred, the wedge member 40 is effective to press the recess 106 firmly against the support bar 110 and to press the flange 66 on the adapter assembly 20 against the inturned lip 70 on the material handling tool 22.

After the adapter assembly 20 has been connected with the material handling tool 22 in the manner previously explained, a piston and cylinder assembly (not shown) is activated to move a piston rod 122 toward the left (as viewed in FIG. 2) to thereby pivot the material handling tool 22 about a pivot connection 124 formed on an arm 126 which is fixedly connected with the boom section 16. As the piston rod 122 moves toward the left (as viewed in FIG. 2), a linkage 132 is actuated to rotate both the material handling tool 22 and the adapter assembly 20 in a counterclockwise direction (as viewed in FIG. 2) about the pivot connection 124. The linkage 134 includes a main link 136 which is pivotally connected at 138 with the boom arm 126. The main link 136 is also pivotally connected at 140 with the outer end of the piston rod 122 and with a link 142 which is pivotally connected at 146 with the adapter assembly 20.

When it is desired to substitute another material handling tool for the material handling tool 22 in order to enable a different work operation to be performed, the material handling tool 22 is lowered to the ground and the plurality of connector assemblies having the same construction as the connector assembly 36 are disconnected by removing the nuts 60 and disengaging the wedge members 40 from the associated wedge surfaces. The piston rod 122 is then actuated to pivot the adapter assembly 20 upwardly about the connection 124. As this occurs, the adapter assembly 20 moves clear of the material handling tool 22. Once this has been accomplished, another material handling tool can be connected with the adapter assembly 20 in the same manner as previously explained in connection with the material handling tool 22.

In view of the foregoing it is apparent that the present invention provides a material handling apparatus 10 in which the adapter assembly 20 on the outer end of the boom 12 is connected with a selected material handling tool 22 by an improved connector assembly 36. The connector assembly 36 includes a wedge member 40 having a pair of sloping side surfaces 42 and 44 which cooperate with wedge surfaces 50 and 54 on the adapter assembly 20 and the material handling tool 22 to securely interconnect the material handling tool and the adapter assembly. The wedging action between the surfaces 42, 44, 50 and 54 is such as to compensate for wear between these surfaces. In addition, the wedging action is effective to press a recess 106 in the adapter assembly 20 into secure engagement with a support member 110 on the material handling tool 22. The wedging action between the wedge member 40 and the wedge surfaces 42, 44, 50 and 54 is also such as to compensate for a slight misalignment between the adapter assembly 20 and the material handling tool 22.

Having described a specific preferred embodiment of the invention, the following is claimed:

1. A material handling apparatus comprising a boom, adapter means connected with an end portion of said boom for engaging a material handling tool, a material handling too, said material handling tool having a rigid wall which is engaged by said adapter means, said rigid wall having an outer side surface which is readily accessible when said adapter means is in engagement with said material handling tool and an inner side surface which is relatively inaccessible when said adapter means is in engagement with said material handling tool, and connector means for releasably interconnecting said adapter means and said material handling tool, said connector means including a wedge member having first and second opposite side surfaces extending at an acute angle relative to each other, a first wedge surface area fixedly connected with said material handling tool, said first wedge surface area being connected with the inner side surface of said material handling tool and being relatively inaccessible when said adapter means is in the engaged position, a second wedge surface area connected with said adapter means, said first and second wedge surface areas extending at the same acute angle relative to each other as do the first and second side surfaces of said wedge member, first portions of said first and second wedge surface areas being spaced apart by a distance which is greater than the maximum distance between the opposite side surfaces on said wedge member, second portions of said first and second wedge surface areas being spaced apart by a distance which is less than the minimum distance between the opposite side surface on said wedge member, said rigid wall including surface means for defining an access opening to enable said wedge member to be moved from a location adjacent the outer side of said rigid wall to a location adjacent to the inner side of said rigid wall to facilitate positioning said wedge member in engagement with said first and second wedge surface areas when said adapter means is disposed in engagement with said material handling tool, and means for moving said wedge member relative to said first and second wedge surface areas to move said side surfaces on said wedge member into tight abutting engagement with said first and second wedge surface areas and to prevent relative movement between said first and second wedge surface areas and said wedge member upon application of operating loads to said material handling tool.

2. An apparatus as set forth in claim 1 wherein said first wedge surface area includes a first section disposed adjacent to one side of the access opening in the rigid wall and a second section disposed adjacent to an opposite side of the access opening.

3. An apparatus as set forth in claim 1 wherein said second wedge surface areas is disposed adjacent to a first edge portion of said adapter means, said adapter means including a recess disposed adjacent to a second edge portion of said adapter means opposite from said first edge portion, said material handling tool including a support member adapted to engage the recess in said adapter means, said wedge member being effective to apply forces against said second wedge surface area to urge the recess in said adapter means into tight abutting engagement with said support member upon movement of said wedge member relative to said first and second wedge surface areas.

4. An apparatus as set forth in claim 1 wherein said material handling tool further includes a top surface area extending transversely to said first wedge surface area, said adapter means including a bottom surface area extending transversely to said second wedge surface area, said connector means being effective to hold said bottom surface on said adapter means in tight abutting engagement with said top surface on said material handling tool.

5. A material handling apparatus comprising a boom, adapter means connected with an end portion of said boom for engaging a material handling tool, said adapter means having a bottom surface area, a material handling tool having a top surface area adapted to engage said bottom surface area of said adapter means, and connector means for releasably interconnecting said adapter means and said material handling tool with said top surface area of said material handling tool in abutting engagement with said bottom surface area of said adapter means, said connector means including a wedge member having first and second opposite side surfaces extending at an acute angle relative to each other, a first wedge surface area fixedly connected with said material handling tool and extending transversely to said top surface area of said material handling tool, a second wedge surface area connected with said adapter means and extending transversely to said bottom surface area of said adapter means, said first and second wedge surface areas extending at the same acute angle relative to each other as do the first and second side surfaces of said wedge member, and fastener means for moving said wedge member relative to said first and second wedge surface areas to move said side surfaces on said wedge member into tight abutting engagement with said first and second wedge surface areas, for pressing said top surface area of said material handling tool into tight abutting engagement with said bottom surface area of said adapter means, and for preventing relative movement between said first and second wedge surface areas and said wedge member upon application of operating loads to said material handling tool, said fastener means including a member connected with said wedge member at a location between said first and second wedge surface areas and extending through openings formed in said top and bottom surface areas of said material handling tool and adapter means.

6. An apparatus as set forth in claim 5 wherein said second wedge surface area is disposed adjacent to a first edge portion of said adapter means, said adapter means including a recess disposed adjacent to a second edge portion of said adapter means opposite from said first edge portion, said material handling tool including a support member adapted to engage the recess in said adapter means, said wedge member being effective to apply forces against said second wedge surface area to urge the recess in said adapter means into tight abutting engagement with said support member upon movement of said wedge member relative to said first and second wedge surface areas.

7. An apparatus as set forth in claim 5 wherein said material handling tool includes a rigid wall which is engaged by said adapter means, said rigid wall having an outer side which is readily accessible when said adapter means is in engagement with said material handling tool and an inner side which is relatively inaccessible when said adapter means is in engagement with said material handling tool, said first wedge surface area being connected with the inner side of said material handling tool and being relatively inaccessible when said adapter means is in the engaged position, said rigid wall including surface means for defining an access opening to enable said wedge member to be moved from a location adjacent the outer side of said rigid wall to a location adjacent to the inner side of said rigid wall to facilitate positioning said wedge member in engagement with said first and second wedge surface areas when said adapter means is disposed in engagement with said material handling tool.

8. An apparatus as set forth in claim 1 wherein said first wedge surface area includes a first section disposed adjacent to one side of the access opening in the rigid wall and a second section disposed adjacent to an opposite side of the access opening.

9. A material handling apparatus comprising a boom, adapter means connected with an end portion of said boom for engaging a material handling tool, said adapter means having a flange extending outwardly in a first direction, a material handling tool, said material handling tool having a sidewall with a flange extending inwardly from said sidewall in a second direction which is opposite from said first direction, and connector means for releasably holding the flanges on said adapter means and material handling tool in tight abutting engagement, said connector means including a wedge member having first and second opposite side surfaces extending at an acute angle relative to each other, a first wedge surface area facing inwardly and fixedly connected with said sidewall of said material handling tool at a location adjacent to the flange on said material handling tool, a second wedge surface area facing outwardly and connected with said adapter means at a location adjacent to the flange on said adapter means, said first and second wedge surface areas extend at the same acute angle relative to each other as do the first and second side surfaces of said wedge member, first portions of said first and second wedge surface areas being spaced apart by a distance which is greater than the maximum distance between the opposite side surfaces on said wedge member, second portions of said first and second wedge surface areas being spaced apart by a distance which is less than the minimum distance between the opposite side surface on said wedge member, and fastener means for moving said wedge member relative to said first and second wedge surface areas to move said side surfaces on said wedge member into tight abutting engagement with said first and second wedge surface areas, for pressing the flanges on said material handling tool and said adapter means into tight abutting engagement with each other, and for preventing relative movement between said first and second wedge surface areas and said wedge member upon application of operating loads to said material handling tool, said fastener means being connected with said wedge member at a location between said first and second wedge surface areas.

* * * * *

UNITED STATES PATENT AND TRADEMARK OFFICE

CERTIFICATE OF CORRECTION

PATENT NO. : 4,111,320

DATED : September 5, 1978

INVENTOR(S) : Robert D. Breeding

It is certified that error appears in the above-identified patent and that said Letters Patent are hereby corrected as shown below:

Column 5, line 51, change "too" to --tool--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*